US008023839B2

(12) United States Patent
Sakatani et al.

(10) Patent No.: US 8,023,839 B2
(45) Date of Patent: Sep. 20, 2011

(54) DEVELOPING APPARATUS AND IMAGE FORMING MACHINE

(75) Inventors: Kazuomi Sakatani, Toyokawa (JP); Katsuyuki Hirata, Toyokawa (JP); Mitsuru Obara, Toyohashi (JP); Yoshinori Tsutsumi, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 57 days.

(21) Appl. No.: 12/395,906

(22) Filed: Mar. 2, 2009

(65) Prior Publication Data

US 2009/0310984 A1 Dec. 17, 2009

(30) Foreign Application Priority Data

Jun. 12, 2008 (JP) ..... 2008-153885

(51) Int. Cl.
*G03G 15/08* (2006.01)

(52) U.S. Cl. ..... 399/30; 399/57; 399/58

(58) Field of Classification Search ..... 399/30, 399/57, 58, 61, 62
See application file for complete search history.

(56) References Cited

U.S. PATENT DOCUMENTS 5,365,319 A 11/1994 Sakemi et al.
6,542,704 B2 * 4/2003 Suetsugu ..... 399/57

FOREIGN PATENT DOCUMENTS

JP 59-10047 A 6/1984
JP 5-341654 A 12/1993
JP 11-065280 3/1999
JP 2001-166593 6/2001
JP 2001-255743 9/2001

OTHER PUBLICATIONS

Notification of Reason for Refusal issued in the corresponding Japanese Patent Application No. 2008-153885 dated May 11, 2010, and an English Translation thereof.

* cited by examiner

*Primary Examiner* — Hoang Ngo

(74) *Attorney, Agent, or Firm* — Buchanan Ingersoll & Rooney PC

(57) ABSTRACT

The developing apparatus, having stirring members for conveying and stirring developer-tank-contained developer and a developer holder, comprises a developer replenishing tank; a toner concentration detecting sensor; a trickle-type discharging mechanism; a developer amount estimating sensor; and a controller for controlling replenishment operation for replenishing the toner and the carrier for replenishment to the developer tank when the toner concentration is lower than a predetermined reference toner concentration, wherein the controller determines the amounts of the toner and the carrier to be replenished on the basis of the calculated toner concentration and the estimated amount of the developer.

20 Claims, 5 Drawing Sheets

DEVELOPING APPARATUS AND IMAGE FORMING MACHINE

This application is based on applications No. 2008-153885 filed in Japan, the contents of which are hereby incorporated by reference.

BACKGROUND OF THE INVENTION

1. Field of the Invention

The present invention relates to a developing apparatus for use in an electrophotographic image forming machine and to an image forming machine incorporating the developing apparatus. More particularly, the present invention relates to a trickle developing apparatus that gradually supplies fresh developer and gradually discharge deteriorated developer and to an image forming machine incorporating the developing apparatus.

2. Description of the Related Art

As developing systems employed for electrophotographic image forming machinees, the one-component developing system in which toner is used as the main component of the developer and the two-component developing system in which toner and carrier are used as the main components of the developer are known.

The two-component developing system that uses toner and carrier, in which the toner and carrier are charged by friction contact therebetween to predetermined polarities, has a characteristic that the stress on the toner is less than that in the one-component developing system that uses a one-component developer. Since the surface area of the carrier is larger than that of the toner, the carrier is less contaminated with the toner attached to the surface thereof. However, with the use for a long period, contamination (spent) attached to the surface of the carrier increases, whereby the capability of charging the toner is reduced gradually. As a result, problems of photographic fog and toner scattering occur. Although it is conceivable that the amount of the carrier stored in a two-component developing apparatus is increased to extend the life of the developing apparatus, this is undesirable because the developing apparatus becomes larger in size.

To solve the problems encountered in the two-component developer, Patent document 1 discloses the so-called trickle developing apparatus being characterized in that fresh developer is gradually replenished into the developing apparatus and developer deteriorated in charging capability is gradually discharged from the developing apparatus, whereby the increase of the deteriorated carrier is suppressed. The developing apparatus is configured to maintain the volume level of the developer inside the developing apparatus approximately constant by discharging an excessive amount of deteriorated developer using the change in the volume of the developer. In the trickle developing apparatus, the deteriorated carrier inside the developing apparatus is gradually replaced with fresh carrier, and the charging performance of the carrier inside the developing apparatus can be maintained approximately constant.

In the trickle developing apparatus, since developer is replenished while the developer inside the developing apparatus is discharged, the amount of the developer existing inside the developing apparatus changes, and the amount of the developer existing inside the developing apparatus is not constant at all times. Hence, the trickle developing apparatus has a problem of causing a toner concentration detection error owing to the difference in the amount of the developer inside the developing apparatus even though the toner concentration is the same.

As main methods for detecting the toner concentration in the two-component developing system in which toner and carrier are used, an optical detection method for detecting the content ratio of toner per unit area by detecting the reflection amount of the light irradiated to developer and a magnetic detection method for detecting the content ratio of toner per unit volume by detecting the permeability of magnetic carrier are available. The magnetic detection method is generally used in view of the cost of a sensor itself and the staining properties of the sensor.

The magnetic detection method has a problem of causing an error in the detection of the toner concentration since the permeability in the detection area changes not only owing to the change in the toner concentration but also owing to bulk density because of the principle of the detection thereof.

Hence, to prevent errors from occurring in the detection of the toner concentration, Patent document 2 has proposed a technology in which the change in the toner concentration of developer and the change in the density thereof are detected using sensors based on different detection principles, such as an optical sensor and a magnetic sensor, and the correction amount corresponding to the change in density is added to the toner concentration obtained using the optical sensor.

[Patent document 1] Japanese Patent Application Laid-Open Publication No. Sho 59-100471

[Patent document 2] Japanese Patent Application Laid-Open Publication No. Hei 05-341654

However, in the technology disclosed in Patent document 2, since multiple sensors based on different detection principles are disposed, there are problems in which it is difficult to make the developing apparatus compact, the control method therefor is complicated, and the cost is high. Furthermore, in the technology disclosed in Patent document 2, the toner concentration obtained using an optical sensor is corrected to an appropriate toner concentration using the correction amount corresponding to the change in density, but the amount of the developer inside the developing apparatus is not estimated or detected.

Moreover, in the trickle developing apparatus in which the amount of the developer existing inside the developing apparatus changes, even if the toner concentration is detected accurately, there is a problem in which if a constant amount of developer is replenished continuously, the toner concentration inside the developing apparatus becomes different from an appropriate reference toner concentration. In other words, in the case that the amount of the developer existing inside the developing apparatus is small, if a constant amount of developer is replenished continuously, the replenishment amount of toner becomes too large, and the toner concentration inside the developing apparatus continues to be higher than the reference toner concentration. Conversely, in the case that the amount of the developer existing inside the developing apparatus is large, if a constant amount of developer is replenished continuously, the replenishment amount of toner becomes too small, and the toner concentration inside the developing apparatus continues to be lower than the reference toner concentration. Hence, in both cases, the toner concentration inside the developing apparatus becomes different from the appropriate reference toner concentration.

Accordingly, the technical problem to be solved by the present invention is to provide a developing apparatus and an image forming machine capable of carrying out excellent image formation for a long period by replenishing an appropriate amount of developer depending on toner concentration and the amount of developer for a trickle developing apparatus that uses a two-component developer.

SUMMARY OF THE INVENTION

To solve the above-mentioned technical problem, the present invention provides a developing apparatus having stirring members for stirring a developer-tank-contained developer containing toner and carrier inside a developer tank while conveying the developer and a developer holder disposed adjacent to the stirring members to supply the stirred developer-tank-contained developer to an electrostatic latent image holder, comprising:

a developer replenishing tank for replenishing the toner and the carrier to the developer tank, a toner concentration detecting sensor for detecting the toner concentration inside the developer tank, a developer amount estimating sensor for estimating the amount of the developer-tank-contained developer existing inside the developer tank, a discharging mechanism provided in the developer tank to discharge an excessive amount of the developer-tank-contained developer outside the developer tank when the amount of the developer-tank-contained developer inside the developer tank exceeds a predetermined amount, and a controller for controlling replenishment operation for replenishing the toner and the carrier for replenishment from the developer replenishing tank to the developer tank when the toner concentration detected using the toner concentration detecting sensor is lower than a predetermined reference toner concentration, wherein the controller determines the amounts of the toner and the carrier to be replenished on the basis of the detected toner concentration and the estimated amount of the developer.

In the above-mentioned developing apparatus, a sort of approximate toner concentration approximate to the true toner concentration is calculated on the basis of the value output from the toner concentration detecting sensor. The amount of the developer existing inside the developer tank is estimated on the basis of the value output from the developer amount estimating sensor.

The replenishment amount required for obtaining the desired toner concentration is determined on the basis of a calculation formula or a table experimentally acquired from the relationship between the calculated toner concentration and the estimated amount of developer and the amount of replenishment, and the replenishment amount is replenished to the developer tank. Hence, an appropriate amount of developer depending on the toner concentration and the amount of the developer inside the developing apparatus is replenished for the trickle developing apparatus that uses a two-component developer, whereby excellent image formation can be carried out for an extended period.

Developer is apt to stay in areas in which the density of developer is high, and this reflects the toner concentration inside the developer tank more accurately. Hence, the toner concentration detecting sensor is installed in an area inside the developer tank in which the density of the developer-tank-contained developer is high. Furthermore, developer is hard to stay in areas in which the density of developer is low, and it is thus assumed that this reflects the amount of the developer inside the developer tank. Therefore, the developer amount estimating sensor is installed in an area inside the developer tank in which the density of the developer-tank-contained developer is low.

As described above, it is preferable that the toner concentration detecting sensor is installed in an area in which the density of the developer is high and that the developer amount estimating sensor is installed in an area in which the density of the developer is low. As the specific installation areas of the respective sensors, the installation area of the toner concentration detecting sensor is an area around the extreme downstream position of a first conveying passage located away from the latent image holder, and the installation area of the developer amount estimating sensor is an area on the upstream side of the extreme downstream position of the first conveying passage.

Still further, as the other specific installation areas of the respective sensors, the installation area of the toner concentration detecting sensor is an area located below the installation area of the developer amount estimating sensor in the side view of the first conveying passage.

The above-mentioned developing apparatus is incorporated and used in an image forming machine comprising a rotatable electrostatic latent image holder for holding electrostatic latent images on the circumferential face thereof, stirring members for stirring a developer-tank-contained developer containing toner and carrier inside a developer tank while conveying the developer, and a developer holder disposed adjacent to the stirring members to supply the stirred developer-tank-contained developer to the electrostatic latent image holder.

DESCRIPTION OF THE PREFERRED EMBODIMENT

Figure 1:
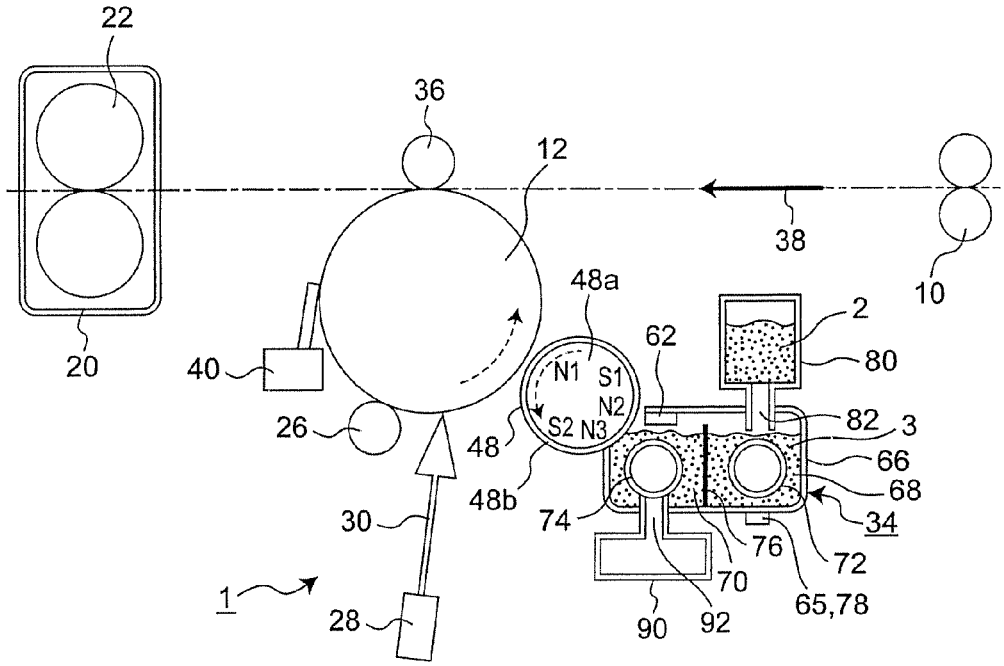
FIG. 1 is a view showing the outline configuration of an image forming machine according to a first embodiment of the present invention.

Preferred embodiments according to the present invention will be described below referring to the accompanying drawings. Although terms meaning specific directions (for example, "above," "below," "left" and "right" and other terms including these, and "clockwise" and "counterclockwise") are used in the following description, they are used for purposes of facilitating the understanding of the present invention referring to the drawings, and it should not be construed that the present invention is limited by the meanings of the terms. Furthermore, in an image forming machine 1 and a developing apparatus 34 described below, identical or similar components are designated by the same reference numerals.

The image forming machine 1 and the developing apparatus 34 incorporated therein according to a first embodiment of the present invention will be described referring to FIGS. 1 to 6.

[Image Forming Machine]

FIG. 1 shows the components relating to image formation in the electrophotographic image forming machine 1 according to the present invention. The image forming machine 1 may be a copier, a printer, a facsimile machine or a compound machine combinedly equipped with the functions of these. The image forming machine 1 has a photosensitive member 12 serving as an electrostatic latent image holder. Although the photosensitive member 12 is formed of a cylinder in this embodiment, the photosensitive member 12 is not limited to have such a shape in the present invention, but it is possible to use an endless belt-type photosensitive member instead. The photosensitive member 12 is connected to a motor (not shown) so as to be driven and is rotated on the basis of the driving of the motor in the direction indicated by the arrow. Around the circumference of the photosensitive member 12, a charging device 26, an exposure device 28, a developing apparatus 34, a transfer device 36 and a cleaning device 40 are respectively arranged along the rotation direction of the photosensitive member 12.

The charging device 26 charges the photosensitive layer, that is, the outer circumferential face of the photosensitive member 12, to a predetermined potential. Although the charging device 26 is represented as a cylindrical roller in this embodiment, instead of this, it is also possible to use charging devices of other forms (for example, a rotary or fixed brush type charging device and a wire discharging type charging device). The exposure device 28 disposed at a position close to or away from the photosensitive member 12 emits image light 30 toward the outer circumferential face of the charged photosensitive member 12. An electrostatic latent image having an area wherein the image light 30 is projected and the charged potential is attenuated and an area wherein the charged potential is almost maintained is formed on the outer circumferential face of the photosensitive member 12 that has passed the exposure device 28. In this embodiment, the area wherein the charged potential is attenuated is the image area of the electrostatic latent image, and the area wherein the charged potential is almost maintained is the non-image area of the electrostatic latent image. The developing apparatus 34 develops the electrostatic latent image into a visible image using a developer-tank-contained developer 3 described later. The details of the developing apparatus 34 are described later. The transfer device 36 transfers the visible image formed on the outer circumferential face of the photosensitive member 12 onto paper 38 or film. Although the transfer device 36 is shown as a cylindrical roller in the embodiment shown in FIG. 1, it is also possible to use transfer devices having other forms (for example, a wire discharging type transfer device). The cleaning device 40 recovers non-transferred toner not transferred to the paper 38 by the transfer device 36 but remaining on the outer circumferential face of the photosensitive member 12 from the outer circumferential face of the photosensitive member 12. Although the cleaning device 40 is shown as a plate-like blade in this embodiment, instead of this, it is also possible to use cleaning devices having other forms (for example, a rotary or fixed brush-type cleaning device).

When the image forming machine 1 configured as described above forms an image, the photosensitive member 12 is rotated counterclockwise, for example, on the basis of the driving of the motor (not shown). At this time, the outer circumferential area of the photosensitive member 12 passing the charging device 26 is charged to a predetermined potential at the charging device 26. The outer circumferential area of the charged photosensitive member 12 is exposed to the image light 30 at the exposure device 28, and an electrostatic latent image is formed. As the photosensitive member 12 is rotated, the electrostatic latent image is conveyed to the developing apparatus 34 and developed into a visible image using the developing apparatus 34. As the photosensitive member 12 is rotated, the toner image developed into the visible image is conveyed to the transfer device 36 and transferred to the paper 38 using the transfer device 36. The paper 38 to which the toner image is transferred is conveyed to a fixing device 20, and the toner image is fixed to the paper 38. The outer circumferential area of the photosensitive member 12 having passed the transfer device 36 is conveyed to the cleaning device 40 in which the toner not transferred to the paper 38 but remaining on the outer circumferential face of the photosensitive member 12 is scraped off from the photosensitive member 12.

[Developing Apparatus]

The developing apparatus 34 is provided with a two-component developer containing non-magnetic toner (hereafter simply referred to as toner) and magnetic carrier (hereafter simply referred to as carrier) and a developer tank 66 accommodating various members. The developer tank 66 has an opening section being open toward the photosensitive member 12, and a developing roller 48 is installed in a space formed near the opening section. The developing roller 48 serving as a developer holder is a cylindrical member that is rotatably supported in parallel with the photosensitive member 12 while having a predetermined developing gap to the outer circumferential face of the photosensitive member 12.

The developing roller 48 is the so-called magnetic roller having a magnet 48*a* secured so as not to be rotatable and a cylindrical sleeve 48*b* (first rotating cylinder) supported so as to be rotatable around the circumference of the magnet 48*a*. Above the sleeve 48*b* of the developing roller 48, a regulating plate 62 secured to the developer tank 66 and extending in parallel with the center axis of the sleeve 48*b* of the developing roller 48 is disposed so as to be opposed thereto with a predetermined regulating gap therebetween. The magnet 48*a* disposed inside the developing roller 48 has five magnetic poles N1, S2, N3, N2 and S1 in the rotation direction of the sleeve 48*b*. Among these magnetic poles, the main magnetic pole N1 is disposed so as to be opposed to the photosensitive member 12. The magnetic poles N2 and N3 having the same polarity and generating a repulsive magnetic field for detaching the developer from the surface of the sleeve 48*b* are disposed so as to be opposed to each other inside the developer tank 66. The sleeve 48*b* of the developing roller 48 rotates in the direction opposite to the rotation direction of the photosensitive member 12 (counter direction).

Figure 2:
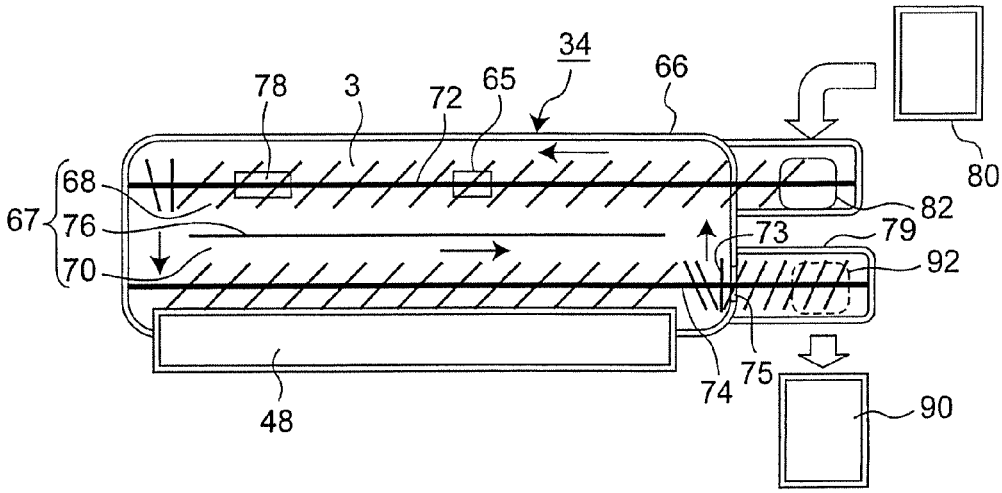
FIG. 2 is a schematic sectional view showing the developing apparatus of the image forming machine shown in FIG. 1 as seen from above.

FIG. 2 is a schematic sectional view showing the developing apparatus 34 as seen from above. As shown in FIG. 2, a developer stirring and conveying chamber 67 is formed behind the developing roller 48. The developer stirring and conveying chamber 67 comprises a second conveying passage 70 formed near the developing roller 48, a first conveying passage 68 formed away from the developing roller 48 and a partition wall 76 for partitioning the space between the first conveying passage 68 and the second conveying passage 70. Above the upstream side of the conveying direction of the first conveying passage 68, a developer replenishing tank 80 is disposed, and the developer replenishing tank 80 communicates with the first conveying passage 68 via a replenishing port 82. The developer replenishing tank 80 is filled with a replenishment developer 2 containing toner as a major ingredient and carrier. The ratio of the carrier in the replenishment developer 2 is preferably 5 to 40 wt %, further preferably 10 to 30 wt %. In addition, below the downstream side of the conveying direction of the second conveying passage 70, a developer recovery tank 90 is disposed, and the developer recovery tank 90 communicates with the second conveying passage 70 via a recovery port 92.

At the bottom of the developer replenishing tank 80, a developer supplying roller is disposed, the driving operation of which is controlled using a controller 100. When the developer supplying roller is rotated by driving and rotating a motor for replenishment, the replenishment developer 2, which is fresh and the amount of which corresponds to the driving time of the roller, flows downward and is supplied to the first conveying passage 68 of the developer tank 66.

In the first conveying passage 68, a first screw 72 serving as a stirring member for conveying the developer-tank-contained developer 3 while stirring the developer is rotatably supported. In the second conveying passage 70, a second screw 74 for conveying the developer-tank-contained developer 3 from the first conveying passage 68 to the developing roller 48 while stirring the developer is rotatably supported. The first screw 72 and the second screw 74 are each a spiral screw in which a spiral vane with a predetermined pitch is secured to a shaft. In this case, the upper portions of the partition wall 76 located at both end sections of the first conveying passage 68 and the second conveying passage 70 are cut out, and communicating passages are formed. The developer-tank-contained developer 3 having reached the end section on the downstream side in the conveying direction of the first conveying passage 68 is sent into the second conveying passage 70 via the communicating passage, and the developer-tank-contained developer 3 having reached the end section on the downstream side in the conveying direction of the second conveying passage 70 is sent into the first conveying passage 68 via the communicating passage. As a result, the developer-tank-contained developer 3 is circulated inside the developer stirring and conveying chamber in the direction indicated by the arrows shown in FIG. 2.

The first screw 72 and the second screw 74 are each a spiral screw in which a spiral vane with a predetermined pitch is secured to a shaft. As shown at the right end section shown in FIG. 2, the second screw 74 is extended rightward in the figure and further extended above the recovery port 92. At each of the positions corresponding to the communicating passage from the second conveying passage 70 to the first conveying passage 68 and to the downstream side end section of the second conveying passage 70, the second screw 74 has a reverse vane section in which the spiral direction of the spiral screw is opposite to that at the other section. The pitch of the vane of the second screw 74 at the downstream side end section (the right end section in FIG. 2) in the conveying direction is made smaller than that at the other section. As a result, when the second screw 74 is rotated, the level of the developer-tank-contained developer 3 at the downstream side end section (the right end section) in the conveying direction of the second screw 74 becomes higher than that at the other vane section. In other words, a rising of the developer-tank-contained developer 3 is formed at the downstream side end section (the right end section) in the conveying direction of the second conveying passage 70.

Since the developing apparatus 34 employs the so-called trickle system, the developing apparatus has an outlet 75 for allowing an excessive amount of the developer-tank-contained developer 3 to flow out. In other words, the outlet 75 is formed by providing a cutout 75 that is formed by partially cutting out the upper portion of the side wall located at the downstream side end section (the right end section) in the conveying direction of the second conveying passage 70. In a usual state, the developer being conveyed using the second screw 74 is stopped using the reverse vane section and conveyed from the second conveying passage 70 to the first conveying passage 68 as indicated by the solid-line arrows shown in FIG. 2. When the developer-tank-contained developer 3 increases inside the developer tank and the developer level inside the developer tank rises, the developer-tank-contained developer 3 climbs over the outlet 75 disposed at the upper portion of the side wall against the stopping action of the reverse vane section and overflows to a recovery chamber adjacent thereto. The excessive amount of the developer-tank-contained developer 3 overflowed to the recovery chamber is conveyed to the recovery port 92 and recovered (dumped) into the developer recovery tank 90 via the recovery port 92.

As shown in FIG. 2, on the bottom face of the developer stirring and conveying chamber 67, a magnetic-type toner concentration detecting sensor 78 for detecting the toner concentration inside the developer stirring and conveying chamber 67 is provided. The magnetic-type toner concentration detecting sensor 78 detects the change in the permeability of the magnetic carrier contained in the developer-tank-contained developer 3 on the basis of the change in the inductance of a coil, for example, and outputs a value corresponding to the change in the permeability. The ratio of the toner in the developer-tank-contained developer 3 is obtained on the basis of the output value output from the toner concentration detecting sensor 78. For example, when the amount of the carrier contained in the developer-tank-contained developer 3 is small, it is detected that the ratio of the toner is high. On the other hand, when the amount of the carrier contained in the developer-tank-contained developer 3 is large, it is detected that the ratio of the toner is low.

The developer-tank-contained developer 3 is apt to stay in areas in which the density of the developer-tank-contained developer 3 is high, and this reflects the toner concentration inside the developer tank 66 more accurately. Hence, the toner concentration detecting sensor 78 is installed in an area in which the developer-tank-contained developer 3 is apt to stay, for example, in an area around the extreme downstream position of the first conveying passage 68 and ahead of the communicating passage being bent toward the second conveying passage 70, the so-called bend area, as shown in FIG. 2.

Furthermore, as shown in FIG. 2, on the bottom face of the developer stirring and conveying chamber 67, a magnetic-type developer amount estimating sensor 65 for estimating the amount of the developer-tank-contained developer 3 existing inside the developer stirring and conveying chamber 67 is provided. The developer amount estimating sensor 65 is installed in an area in which the developer-tank-contained developer 3 is hard to stay, that is, an area in which the density of the developer-tank-contained developer 3 is low, for example, an intermediate area in the approximately intermediate portion of the first conveying passage 68 as shown in FIG. 2. Like the magnetic-type toner concentration detecting sensor 78 described above, the magnetic-type developer amount estimating sensor 65 detects the change in the permeability of the magnetic carrier contained in the developer-tank-contained developer 3 on the basis of the change in the conductance of a coil and outputs a value corresponding to the change in permeability. As described later, the amount of the developer-tank-contained developer 3 is estimated on the basis of the toner concentration accurately detected using the toner concentration detecting sensor 78 and the output value from the magnetic-type developer amount estimating sensor 65 as described later.

In addition, the respective voltage signals output from the toner concentration detecting sensor 78 and the developer amount estimating sensor 65 are input to the controller 100, a required replenishing amount is calculated on the basis of the voltage signals, the developer replenishing roller of the developer replenishing tank 80 is driven, and the predetermined amount of the replenishment developer 2 is replenished into the developer tank 66.

In the developing apparatus 34, when the toner concentration of the circulating developer-tank-contained developer 3 lowers as the printing operation proceeds, the replenishment developer 2 containing toner and a small amount of carrier is replenished from the developer replenishing tank 80. The replenishment developer 2 is supplied in a form in which toner and carrier are integrated or in a form in which toner and carrier are separated. The fresh replenishment developer 2 having been replenished is conveyed along the first conveying passage 68 and the second conveying passage 70 of the above-mentioned developer stirring and conveying chamber 67 while being mixed and stirred with the developer-tank-contained developer 3 already existing therein. Although the toner is basically consumed on the photosensitive member 12, the carrier is accumulated inside the developing apparatus 34, and the charging performance of the carrier lowers gradually as the number of printed sheets increases. Since a small amount of the carrier that is bulkier than the toner is contained in the replenishment developer 2, as the replenishment developer 2 is replenished, the amount of the developer-tank-contained developer 3 gradually increases inside the developing apparatus 34. Then, the developer-tank-contained developer 3 having increased in volume circulates in the developer stirring and conveying chamber 67. An excessive amount of the developer-tank-contained developer 3 being unable to circulate in the developer stirring and conveying chamber 67 climbs over the reverse vane section and flows out from the outlet 75 provided at the downstream side end section (the right end section) in the conveying direction of the second conveying passage 70 and is recovered in the developer recovery tank 90 via the recovery port 92.

The first conveying passage 68 and the second conveying passage 70 constituting the developer stirring and conveying chamber 67 can have various configurations; for example, the passages are disposed at the same height as shown in FIG. 1 or disposed at different heights (not shown).

The replenishing amount of the replenishment developer 2 is determined on the basis of the toner concentration of the developer-tank-contained developer 3 detected using the toner concentration detecting sensor 78, the image information (dot counter) at the time of image formation and the ratio of the carrier in the replenishment developer 2 inside the developer replenishing tank 80. The ratio of the carrier in the replenishment developer 2 inside the developer replenishing tank 80 is adjusted to the extent that the carrier inside the developing apparatus 34 is suppressed from deteriorating and that the cost is not increased. As the toner replenishing operation proceeds, the carrier is supplied gradually.

Figure 3:
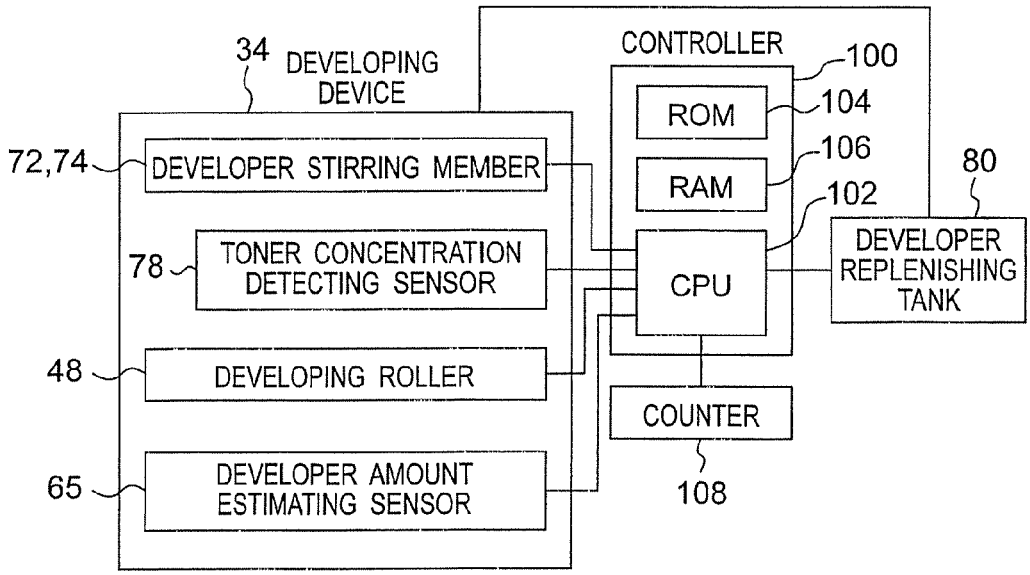
FIG. 3 is a block diagram of the developing apparatus of the image forming machine shown in FIG. 2.

FIG. 3 is a control block diagram of the developing apparatus 34 of the image forming machine 1.

The controller 100 serving as controlling means comprises a CPU (central processing unit) 102, a ROM (read only memory) 104, a RAM (random access memory) 106, etc. The CPU 102 concentratedly controls various operations in the image forming machine 1 according to various processing programs and tables stored inside the ROM 104. In the ROM 104, for example, a toner concentration calculation table for carrying out calculation for conversion to the toner concentration of the developer-tank-contained developer 3 on the basis of the output voltage value output from the toner concentration detecting sensor 78, a developer amount estimating table or a calculation formula for estimating the amount of the developer-tank-contained developer 3 on the basis of the toner concentration obtained using the toner concentration detecting sensor 78 and the output value from the developer amount estimating sensor 65 and a developer replenishing table or a calculation formula for calculating the amount of the replenishment developer 2 on the basis of the calculated toner concentration and the estimated amount of the developer-tank-contained developer 3 are stored. The RAM 106 provides a work area in which various programs to be executed by the controller 100 and data for the programs are temporarily stored.

The developing apparatus 34, the developer replenishing tank 80 and a counter 108 are connected to the CPU 102. The operations of the stirring members 72 and 74, the toner concentration detecting sensor 78, the developer amount estimating sensor 65 and the developing roller 48, constituting the developing apparatus 34, are controlled using the CPU 102 of the controller 100. The CPU 102 of the controller 100 is used as stirring member rotation controller for controlling the rotation speeds of the stirring members 72 and 74. In addition, the CPU 102 is used as adjusting device for adjusting the above-mentioned predetermined amount replenished from the developer replenishing tank depending on the output of the developer amount estimating sensor 65. Furthermore, the output voltage value output from the toner concentration detecting sensor 78, the calculated toner concentration, the output voltage value output from the developer amount estimating sensor 65, the estimated amount of the developer-tank-contained developer 3, image information at the time of image formation, the ratio of the carrier in the replenishment developer 2 inside the developer replenishing tank 80, etc. are temporarily stored in the RAM 106.

[Developer]

The two-component developer contains toner and carrier for charging the toner. In the present invention, the known toner that has been used generally and conventionally can be used for the image forming machine 1. The particle diameter of the toner is, for example, approximately 3 to 15 μm. It is also possible to use toner containing a coloring agent in a binder resin, toner containing a charge control agent and a releasing agent, and toner holding additives on the surface.

The toner is produced using known methods, such as the grinding method, the emulsion polymerization method and the suspension polymerization method.

Examples of the binder resin being used for the toner include styrene resins (homopolymers or copolymers containing styrene or styrene substitutes), polyester resins, epoxy resins, polyvinyl chloride resins, phenol resins, polyethylene resins, polypropylene resins, polyurethane resins, silicone resins or any appropriate combinations of these resins, although not restricted to these. The softening temperature of the binder resin is preferably in the range of approximately 80 to 160° C., and the glass transition temperature thereof is preferably in the range of approximately 50 to 75° C.

As the coloring agent, it is possible to use known materials, such as carbon black, aniline black, activated charcoal, magnetite, benzine yellow, permanent yellow, naphthol yellow, phthalocyanine blue, fast sky blue, ultramarine blue, rose bengal and lake red. In general, the additive amount of the coloring agent is preferably 2 to 20 parts by weight per 100 parts by weight of the binder resin.

The materials conventionally known as charge control agents can be used as the charging control agent. More specifically, for the toner that is positively charged, it is possible to use materials, such as nigrosin dyes, quaternary ammonium salt compounds, triphenylmethane compounds, imidazole compounds and polyamine resins, as the charge control agent. For the toner that is negatively charged, it is possible to use materials, such as azo dyes containing metals such as Cr, Co, Al and Fe, salicylic acid metal compounds, alkyl salicylic acid metal compounds and calixarene compounds, as the charge control agent. It is desirable that the charge control agent is used in the ratio of 0.1 to 10 parts by weight per 100 parts by weight of the binder resin.

The materials conventionally known and used as releasing agents can be used as the releasing agent. As the material of the releasing agent, it is possible to use materials, such as polyethylene, polypropylene, carnauba wax, sasol wax or any appropriate combinations of these. It is desirable that the releasing agent is used in the ratio of 0.1 to 10 parts by weight per 100 parts by weight of the binder resin.

Furthermore, it may be possible to add a fluidizer for accelerating the fluidization of the developer. As the fluidizer, it is possible to use inorganic particles, such as silica, titanium oxide and aluminum oxide, and resin particles, such as acrylic resins, styrene resins, silicone resins and fluororesins. It is particularly desirable to use materials hydrophobized using a silane coupling agent, a titanium coupling agent, silicone oil, etc. It is desirable that the fluidizer is added in the ratio of 0.1 to 5 parts by weight per 100 parts by weight of the toner. It is desirable that the number average primary particle diameters of these additives are in the range of 9 to 100 nm.

As the carrier, the known carriers used conventionally and generally can be used. Either the binder-type carrier or the coated-type carrier may be used. It is desirable that the diameter of the carrier particles is in the range of approximately 15 to 100 μm, although not restricted to this range.

The binder-type carrier is that obtained by dispersing magnetic particles in a binder resin and it is possible to use carrier having positively or negatively charged particles or a coating layer on its surface. The charging characteristics, such as polarity, of the binder-type carrier can be controlled depending on the material of the binder resin, electrostatic charging particles and the kind of the surface coating layer.

Examples of the binder resin being used for the binder-type carrier include thermoplastic resins, such as vinyl resins typified by polystyrene resins, polyester resins, nylon resins and polyolefin resins, and thermosetting resins, such as phenol resins.

As the magnetic particles of the binder-type carrier, it is possible to use spinel ferrites, such as magnetite and gamma ferric oxide; spinel ferrites containing one or more kinds of nonferrous metals (such as Mn, Ni, Mg and Cu); magnetoplumbite ferrites, such as barium ferrite; and iron or alloy particles having oxide layers on the surfaces. The shape of the carrier may be particulate, spherical or needle-like. In particular, when high magnetization is required, it is desirable to use iron-based ferromagnetic particles. In consideration of chemical stability, it is desirable to use ferromagnetic particles of spinel ferrites, such as magnetite and gamma ferric oxide, or magnetoplumbite ferrites, such as barium ferrite. It is possible to obtain magnetic resin carrier having the desired magnetization by appropriately selecting the kind and content of the ferromagnetic particles. It is appropriate to add 50 to 90 wt % of the magnetic particles to the magnetic resin carrier.

As the surface coating material of the binder-type carrier, it is possible to use silicone resins, acrylic resins, epoxy resins, fluororesins, etc. The charging capability of the carrier can be enhanced by coating the surface of the carrier with this kind of resin and by thermosetting the resin.

The fixation of electrostatic charging particles or electrically conductive particles to the surface of the binder-type carrier is carried out according to, for example, a method in which the magnetic resin carrier is uniformly mixed with the particles, the particles are attached to the surface of the magnetic resin carrier, and then mechanical and thermal impact forces are applied to the particles to put the particles into the magnetic resin carrier. In this case, the particles are not completely embedded into the magnetic resin carrier but fixed such that parts thereof protrude from the surface of the magnetic resin carrier. As the electrostatic charging particles, organic or inorganic insulating materials are used. More specifically, as organic insulating materials, organic insulating particles, such as polystyrene, styrene copolymers, acrylic resins, various acrylic copolymers, nylon, polyethylene, polypropylene, fluororesins and cross-linked materials of these are available. The charging capability and the charging polarity thereof can be adjusted so as to be suited for the material of the electrostatic charging particles, polymerization catalyst, surface treatment, etc. As the inorganic insulating material, negatively charged inorganic particles, such as silica and titanium dioxide, and positively charged inorganic particles, such as strontium titanate and alumina, are used.

The coated-type carrier is carrier obtained by coating carrier core particles made of a magnetic substance with a resin, and electrostatic charging particles charged positively or negatively can be fixed to the surface of the carrier, as in the case of the binder-type carrier. The charging characteristics, such as polarity, of the coated-type carrier can be adjusted by selecting the kind of the surface coating layer and the electrostatic charging particles. As the coating resin, it is possible to use resins similar to the binder resins for the binder-type carrier.

The mixture ratio of the toner and the carrier of the developer-tank-contained developer 3 is adjusted such that a desired toner charging amount is obtained. The ratio of the toner in the developer-tank-contained developer 3 is preferably 3 to 20 wt % and further preferably 4 to 15 wt % with respect to the total amount of the toner and the carrier. In addition, the replenishment developer 2 stored in the developer replenishing tank 80 contains toner and a small amount of carrier, and the ratio of the carrier in the replenishment developer 2 is preferably 1 to 50 wt % and further preferably 5 to 30 wt %.

The operation of the developing apparatus 34 configured as described above will be described.

At the time of image formation, the sleeve 48*b* of the developing roller 48 is rotated in the direction indicated by the arrow (counterclockwise) on the basis of the driving of the motor (not shown). By the rotation of the first screw 72 and the rotation of the second screw 74, the developer-tank-contained developer 3 existing in the developer stirring and conveying chamber 67 is stirred while being circulated and conveyed between the first conveying passage 68 and the second conveying passage 70. As a result, the toner and the carrier contained in the developer make friction contact and are charged to have polarities opposite to each other. In this embodiment, it is assumed that the carrier is positively charged and that the toner is negatively charged. However, the charging characteristics of the toner and the carrier being used for the present invention are not limited to these combinations. The external size of the carrier is considerably larger than that of the toner. For this reason, the negatively charged toner is attached around the circumference of the positively charged carrier mainly on the basis of the electric attraction force exerted therebetween.

The developer-tank-contained developer 3 charged as described above is supplied to the developing roller 48 in the process of being conveyed to the second conveying passage 70 using the second screw 74. The developer is held on the surface of the sleeve 48*b* by the magnetic force of the magnet 48*a* inside the developing roller 48 and moved while being rotated counterclockwise together with the sleeve 48*b*, the throughput thereof is regulated using the regulating plate 62 disposed so as to be opposed to the developing roller 48, and then the developer is conveyed to the developing area opposed to the photosensitive member 12. Furthermore, in the developing area, chains of particles (magnetic brush) are formed by the magnetic force of the main magnet pole N1 of the magnet 48*a*. In the developing area, by the force of the electric field (electric field of AC superimposed on DC) that is formed between the electrostatic latent image on the photosensitive member 12 and the developing roller 48 to which a developing bias is applied and exerted to the toner, the toner is moved to the electrostatic latent image on the photosensitive member 12, and the electrostatic latent image is developed into a visible image. The developer, the toner of which is consumed in the developing area, is conveyed toward the developer tank 66, detached from the surface of the developing roller 48 by the repulsive magnetic field between the poles N3 and N2 of the magnet 48*a* disposed so as to be opposed to the second conveying passage 70 of the developer tank 66, and then recovered into the developer tank 66. The recovered developer is mixed with the developer-tank-contained developer 3 that is being conveyed to the second conveying passage 70.

When the toner contained in the developer-tank-contained developer 3 is consumed by the image formation described above, it is desirable that the amount of the toner corresponding to the consumed amount is replenished to the developer tank 66. For this purpose, the developing apparatus 34 is equipped with the toner concentration detecting sensor 78 for measuring the ratio of the toner in the developer-tank-contained developer 3 existing in the developer stirring and conveying chamber 67. Furthermore, the developer replenishing tank 80 is provided above the first conveying passage 68.

Next, the operation of the developing apparatus 34 according to the first embodiment will be described referring to FIGS. 4 to 6.

Figure 4:
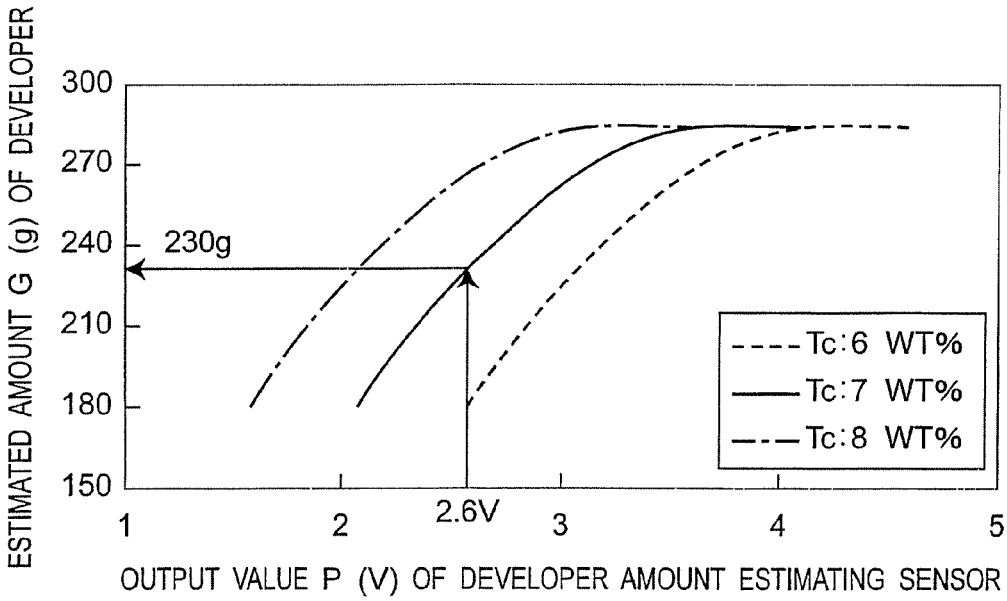
FIG. 4 is a graph showing the relationship between the output voltage value of a developer amount estimating sensor and the estimated amount of developer.

FIG. 4 is a graph showing the relationship between the output voltage value P of the developer amount estimating sensor 65 and the estimated amount G of the developer-tank-contained developer 3. FIG. 5 is a graph showing the relationship between the estimated amount G of the developer-tank-contained developer 3 and the amount S of the developer to be replenished. FIG. 6 is a flowchart showing a subroutine for developer replenishing control in the entire control (main routine) not shown.

When it is assumed that the output voltage value of the developer amount estimating sensor 65 is P and that the estimated amount of the developer is G at the toner concentration Tc obtained using the toner concentration detecting sensor 78, the relationship therebetween is experimentally obtained and approximated, for example, by the second-order developer amount estimating calculation formula (1) described below.

$$G=-33.333\times P^2+(-33.335\times Tc+490)\times P+(128.34\times Tc-1116) \quad (1)$$

FIG. 4 shows cases in which the values of the toner concentration Tc are 6, 7 and 8 wt %, for example. In the case that the above-mentioned second-order developer amount estimating calculation formula (1) has been stored in the ROM 104 and when the toner concentration Tc and the developer amount estimating sensor 65 are obtained, the amount G of the developer-tank-contained developer 3 can be estimated. For example, when the detected toner concentration Tc is 7 wt % and when the output voltage value P of the developer amount estimating sensor 65 is 2.6 V, the amount G of the developer-tank-contained developer 3 is estimated at approximately 224 g.

After the amount G of the developer-tank-contained developer 3 is estimated using the above-mentioned calculation formula, the amount S of the replenishment developer 2 to be replenished at the toner concentration Tc obtained using the toner concentration detecting sensor 78 is calculated using the linear calculation formula (2) described below. The calculation formula (2) for calculating the amount S is obtained under the conditions that the ratio of the carrier in the replenishment developer 2 is 20 wt % and that the reference toner concentration is 7 wt %.

$$S=(1.37\times(Tc/100)+0.0959)\times G \quad (2)$$

Figure 5:
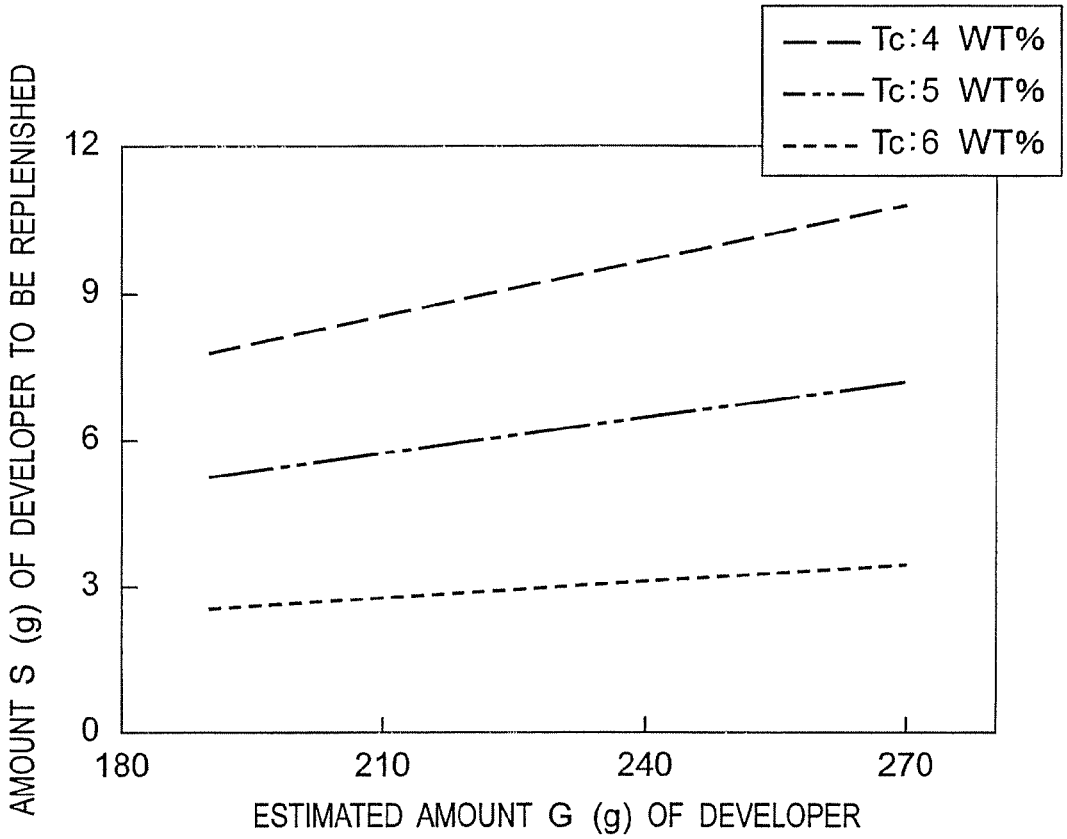
FIG. 5 is a graph showing the relationship between the estimated amount of developer and the amount of developer to be replenished.
Figure 6:
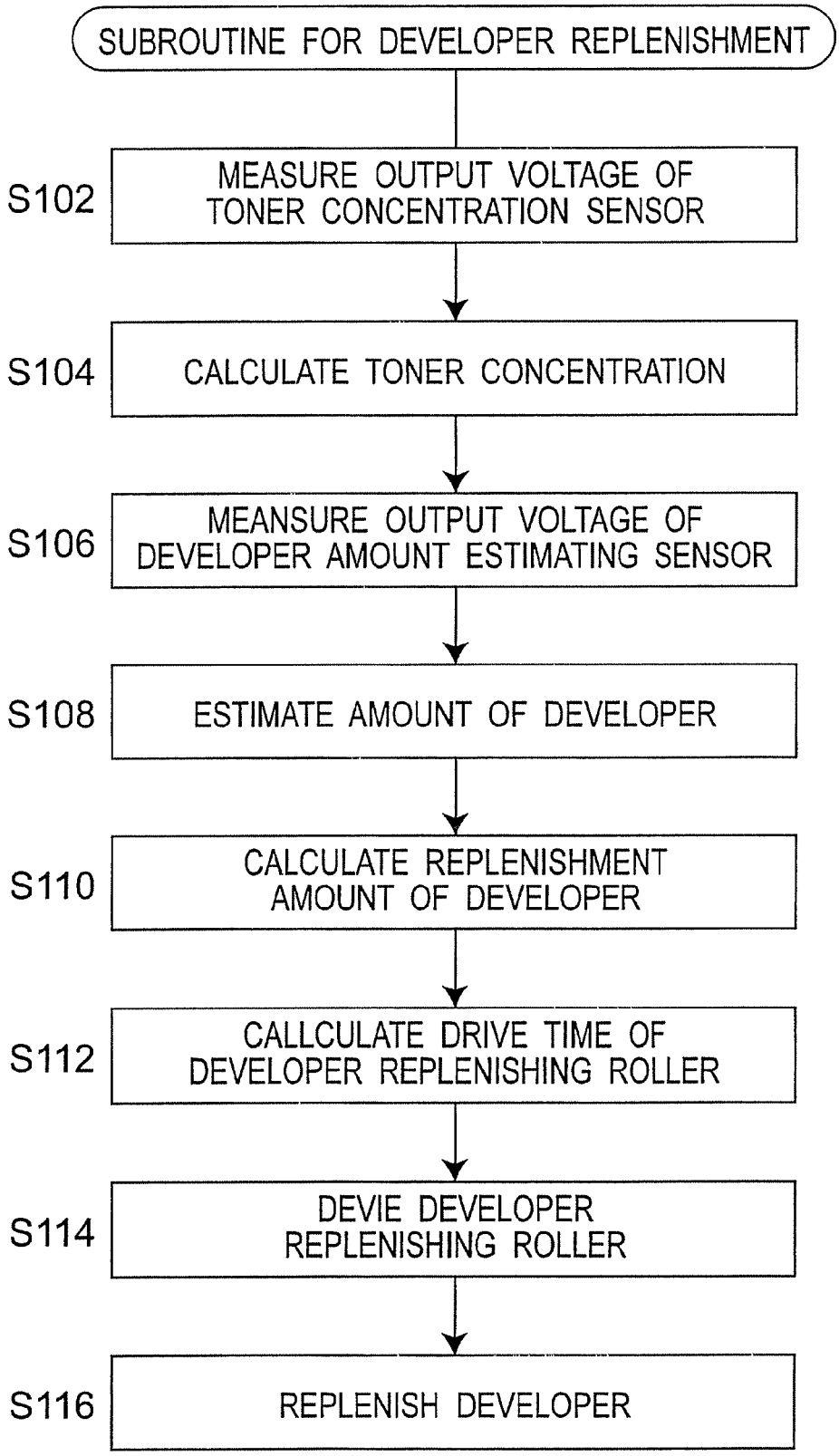
FIG. 6 is a flowchart showing a subroutine for developer replenishing control in the developing apparatus according to the first embodiment of the present invention.

FIG. 5 shows cases in which the values of the toner concentrations Tc are 4, 5 and 6 wt % when the target value is 7 wt %, for example. In the case that the above-mentioned linear replenishment amount calculation formula (2) has been stored in ROM 104, the amount S of the replenishment developer 2 to be replenished can be obtained using the detected toner concentration Tc and the estimated amount G of the developer-tank-contained developer 3. For example, when the detected toner concentration Tc is 6 wt % and when the estimated amount G of the developer-tank-contained developer 3 is 230 g, the amount S of the replenishment developer 2 to be replenished is 3.15 g.

In the case that the amount G of the developer inside the developing apparatus 34 is estimated to be small, if the replenishment of a large amount of the replenishment developer 2 is carried out continuously, the replenishment amount becomes relatively too large, and the toner concentration Tc inside the developing apparatus 34 continues to be high. Hence, in the case that the amount G of the developer inside the developing apparatus 34 is estimated to be small, the replenishment of a small amount of the replenishment developer 2 is carried out. Furthermore, in the case that the amount G of the developer inside the developing apparatus 34 is estimated to be large, if the replenishment of a small amount of the replenishment developer 2 is carried out continuously, the replenishment amount becomes relatively too small, and the toner concentration Tc inside the developing apparatus 34 continues to be low. Hence, in the case that the amount of the developer inside the developing apparatus 34 is estimated to be large, the replenishment of a large amount of the replenishment developer 2 is carried out.

The adjustment of the replenishment amount of the replenishment developer 2 is carried out by adjusting the drive time of the developer replenishing roller. In the case that the drive time of the developer replenishing roller corresponding to the replenishment amount has been obtained beforehand experimentally, and if a specific replenishment amount is determined using the above-mentioned replenishment amount calculation formula (2), the drive time of the developer replenishing roller corresponding to the replenishment amount is determined. The amount of the replenishment developer 2 corresponding to the drive time of the developer replenishing roller flows downward and is supplied to the first conveying passage 68 of the developer tank 66.

A developer replenishment control method, a feature of the present invention, will be described referring to FIG. 6.

At step S102, the output voltage value output from the toner concentration detecting sensor 78 is measured. Then, at step S104, the toner concentration Tc of the developer-tank-contained developer 3 inside the developer tank 66 is calculated on the basis of the output voltage value obtained at step S102.

At step S106, the output voltage value P output from the developer amount estimating sensor 65 is measured. At step S108, the amount G of the developer-tank-contained developer 3 inside the developer tank 66 is estimated on the basis of the toner concentration Tc calculated at step S104 and the output voltage value P obtained at step S104.

At step S110, the replenishment amount of toner, i.e., the replenishment amount S of the replenishment developer 2, is calculated on the basis of the calculated toner concentration Tc and the estimated amount G of the developer-tank-contained developer 3.

At step S112, the drive time of the developer replenishing roller corresponding to the replenishment amount S of the replenishment developer 2 is calculated referring to the developer replenishing table or the calculation formula. At step S114, the developer replenishment roller is driven during the calculated drive time. As a result, at step S116, the amount of the replenishment developer 2 corresponding to the drive time of the developer replenishing roller flows downward and is supplied to the first conveying passage 68 of the developer tank 66.

With the embodiment described above, the replenishment amount S required for obtaining the desired toner concentration Tc is calculated using the calculated toner concentration Tc and the estimated amount G of the developer, and the replenishment amount S is supplied to the developer tank 66. Hence, an appropriate amount of the replenishment developer 2 depending on the toner concentration Tc and the amount G of the developer inside developing apparatus 34 is replenished for the trickle developing apparatus that uses a two-component developer, whereby excellent image formation can be carried out for an extended period.

Next, the developing apparatus 34 according to a second embodiment will be described referring to FIGS. 7 and 8. However, since the configurations of the sections other than those of the characteristic sections according to the second embodiment are the same as those according to the above-mentioned first embodiment, the description regarding the configurations of the sections other than those of the characteristic sections is omitted.

Figure 7:
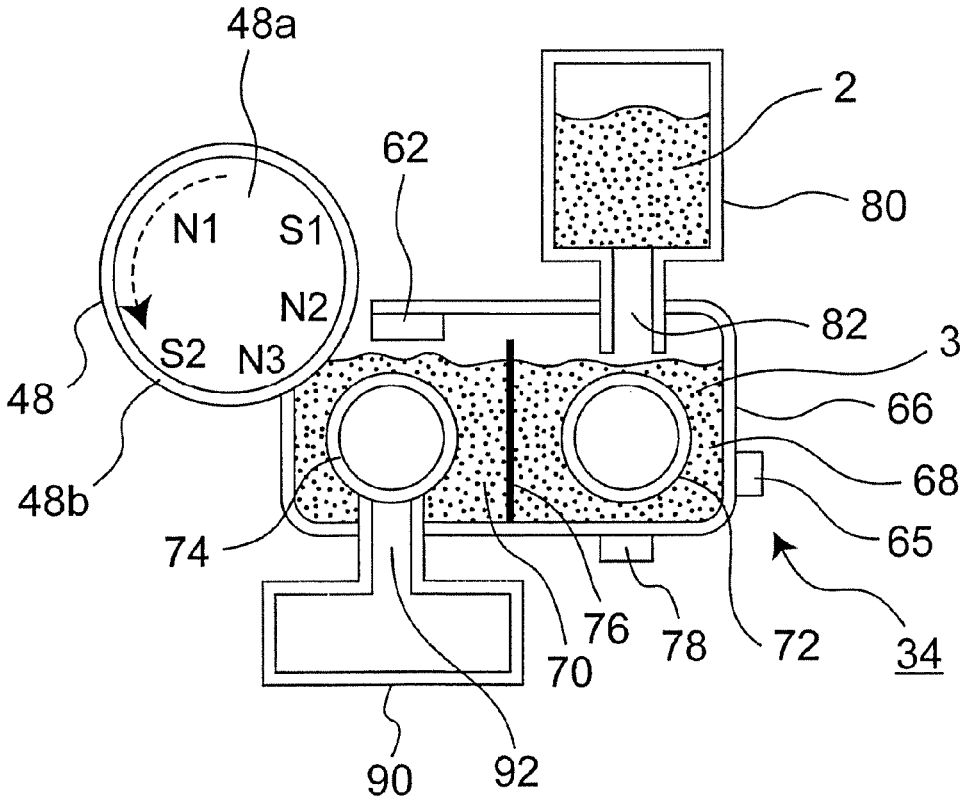
FIG. 7 is a view showing the outline configuration of a developing apparatus according to a second embodiment of the present invention.

FIG. 7 is a view showing the outline configuration of the developing apparatus 34 according to the second embodiment of the present invention. FIG. 8 is a schematic sectional view showing the developing apparatus 34 shown in FIG. 7, as seen from above.

Figure 8:
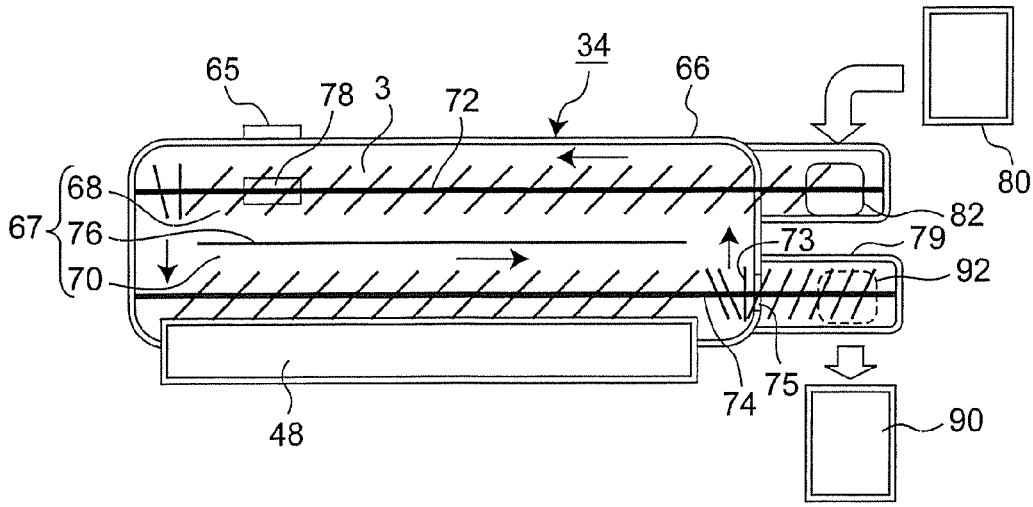
FIG. 8 is a schematic sectional view showing the developing apparatus shown in FIG. 7 as seen from above.

The developing apparatus 34 according to the second embodiment shown in FIGS. 7 and 8 is a modified example of the above-mentioned first embodiment and is characterized in that the toner concentration detecting sensor 78 is installed lower than the developer amount estimating sensor 65 as seen from the side of the first conveying passage 68.

As described above, the toner concentration detecting sensor 78 is installed in an area in which the density of the developer-tank-contained developer 3 inside the developer tank 66 is high, and the developer amount estimating sensor 65 is installed in an area in which the density of the developer-tank-contained developer 3 inside the developer tank 66 is low. In the case that the toner concentration detecting sensor 78 and the developer amount estimating sensor 65 are present in approximately the same cross section on the downstream side of the first conveying passage 68, the toner concentration detecting sensor 78 and the developer amount estimating sensor 65 are respectively installed in areas described below.

As shown in FIGS. 7 and 8, the toner concentration detecting sensor 78 is installed on the bottom face portion of the first conveying passage 68 of the developer tank 66, and the developer amount estimating sensor 65 is installed on the side face portion of the developer tank 66. Alternatively, it may also be possible to have a configuration in which both the toner concentration detecting sensor 78 and the developer amount estimating sensor 65 are installed on the side face portion of the first conveying passage 68 of the developer tank 66, and the toner concentration detecting sensor 78 is installed below the developer amount estimating sensor 65, although this configuration is not shown.

In both embodiments, the replenishment amount S required for obtaining the desired toner concentration is calculated using the calculated toner concentration Tc and the estimated amount G of the developer, and the replenishment amount S is supplied to the developer tank 66. Hence, an appropriate amount of the developer depending on the toner concentration Tc and the amount G of the developer inside developing apparatus 34 is replenished for the trickle developing apparatus that uses a two-component developer, whereby excellent image formation can be carried out for an extended period.

Although the description is given using specific numeric values in the above-mentioned respective embodiments, the present invention is not restricted by the numeric values but can be modified variously without departing from the scope defined in the appended claims and equivalents thereof.

Although each of both the toner concentration detecting sensor 78 and the developer amount estimating sensor 65 uses a magnetic sensor detecting the change in the permeability of the magnetic carrier contained in the developer-tank-contained developer 3 in the above-mentioned embodiments, it is possible to use another sensor with a different detection principle. For example, it is possible to use an optical sensor detecting the amount of the reflected light from the developer. Each of both the toner concentration detecting sensor 78 and the developer amount estimating sensor 65 can use an optical sensor. Alternatively, one of them can use a magnetic sensor and the other can use an optical sensor. However, no optical sensor can be used for black developer comprising black toner containing carbon black as a color material and carrier.

Furthermore, since the pressure per unit area also changes depending on the amount of the developer-tank-contained developer 3 inside the developer tank 66, a pressure sensor of a thin gauge type, a semiconductor strain gauge type, a piezoelectric type or an optical fiber type can be used as the developer amount estimating sensor 65. Hence, it may also be possible to have a configuration in which a pressure sensor is installed on the bottom face portion of the first conveying passage 68 of the developer tank 66 as the toner concentration detecting sensor 78.

Although the replenishment amount S is calculated on the basis of the amount G of the developer-tank-contained developer 3 and the toner concentration Tc obtained using the toner concentration detecting sensor 78 in the above-mentioned embodiments, the present invention is not limited to this method; it may also be possible that the replenishment amount S is obtained using the output values of the developer amount estimating sensor 65 and the toner concentration detecting sensor 78 by preparing a developer amount estimating table in the ROM 104 beforehand.

Moreover, it may also be possible that a replenishment amount S1 is tentatively determined depending on the output of the toner concentration detecting sensor 78 and that the replenishment amount S1 is increased or decreased at a predetermined ratio depending on the developer amount G calculated on the basis of the output of the developer amount estimating sensor 65. More specifically, for example, the ratio should only be set so that the replenishment amount becomes larger when the developer amount G is larger than 230 g or so that the replenishment amount becomes smaller when the developer amount G is smaller than 230 g.

What is claimed is:

1. A developing apparatus having stirring members for stirring a developer containing toner and carrier inside a developer tank while conveying said developer and having a developer holder disposed adjacent to said stirring members to supply said developer to an electrostatic latent image holder, comprising:

a developer replenishing tank containing replenishment toner and replenishment carrier;

a toner concentration detecting sensor for detecting a toner concentration inside said developer tank;

a developer amount estimating sensor for estimating an amount of said developer inside said developer tank;

a discharging mechanism provided in said developer tank to discharge an excessive amount of developer outside said developer tank when said amount of said developer inside said developer tank exceeds a predetermined amount; and a controller for controlling a replenishment operation for transferring a mixture of said replenishment toner and said replenishment carrier from said developer replenishing tank to said developer tank when said toner concentration detected using said toner concentration detecting sensor is lower than a predetermined reference toner concentration, wherein said controller determines specified amounts of said replenishment toner and said replenishment carrier to be transferred from said developer replenishing tank to said developer tank based on said detected toner concentration and said estimated amount of said developer.

2. The developing apparatus according to claim 1, wherein said toner concentration detecting sensor is installed in an area in which density of said developer inside said developer tank is high and said developer amount estimating sensor is installed in an area in which density of said developer inside said developer tank is low.

3. The developing apparatus according to claim 2, wherein said installation area of said toner concentration detecting sensor is an area around an extreme downstream position of a first conveying passage located away from said latent image holder, and said installation area of said developer amount estimating sensor is an area on an upstream side of said extreme downstream position of said first conveying passage.

4. The developing apparatus according to claim 2, wherein said installation area of said toner concentration detecting sensor is an area located below said installation area of said developer amount estimating sensor in a side view of a first conveying passage.

5. The developing apparatus according to claim 1, further comprising:

a first conveying passage for conveying said developer from a first end of said developer tank to a second end of said developer tank; and a second conveying passage for conveying said developer from said second end of said developer tank to said first end of said developer tank, wherein said toner concentration sensor is located adjacent said second end of said developer tank.

6. The developing apparatus according to claim 1, further comprising a developing roller at an opening section of said developer tank.

7. An image forming machine having a rotatable electrostatic latent image holder for holding electrostatic latent images on an circumferential face thereof, stirring members for stirring a developer-tank-contained developer containing toner and carrier inside a developer tank while conveying said developer and a developer holder disposed adjacent to said stirring members to supply said stirred developer-tank-contained developer to said electrostatic latent image holder, comprising:

a developer replenishing tank for replenishing said toner and said carrier to said developer tank;

a toner concentration detecting sensor for detecting a toner concentration inside said developer tank;

a developer amount estimating sensor for estimating an amount of said developer-tank-contained developer existing inside said developer tank;

a discharging mechanism provided in said developer tank to discharge an excessive amount of said developer-tank-contained developer outside said developer tank when said amount of said developer-tank-contained developer inside said developer tank exceeds a predetermined amount; and a controller for controlling a replenishment operation for replenishing a mixture of said toner and said carrier for replenishment from said developer replenishing tank to said developer tank when said toner concentration detected using said toner concentration detecting sensor is lower than a predetermined reference toner concentration, wherein said controller determines specified amounts of said toner and said carrier to be replenished on the basis of said detected toner concentration and said estimated amount of said developer.

8. The image forming machine according to claim 7, wherein said toner concentration detecting sensor is installed in an area in which density of said developer-tank-contained developer inside said developer tank is high and said developer amount estimating sensor is installed in an area in which density of said developer-tank-contained developer inside said developer tank is low.

9. The image forming machine according to claim 8, wherein said installation area of said toner concentration detecting sensor is an area around an extreme downstream position of a first conveying passage located away from said latent image holder, and said installation area of said developer amount estimating sensor is an area on an upstream side of said extreme downstream position of said first conveying passage.

10. The image forming machine according to claim 8, wherein said installation area of said toner concentration detecting sensor is an area located below said installation area of said developer amount estimating sensor in a side view of a first conveying passage.

11. The image forming machine according to claim 7, further comprising:

a first conveying passage for conveying said developer from a first end of said developer tank to a second end of said developer tank; and a second conveying passage for conveying said developer from said second end of said developer tank to said first end of said developer tank, wherein said toner concentration sensor is located adjacent said second end of said developer tank.

12. The image forming machine according to claim 7, further comprising a developing roller at an opening section of said developer tank.

13. A developing method applied to a developing apparatus having stirring members for stirring a developer-tank-contained developer containing toner and carrier inside a developer tank while conveying said developer, a developer holder disposed adjacent to said stirring members to supply said stirred developer-tank-contained developer to an electrostatic latent image holder, a developer replenishing tank for replenishing said toner and said carrier to said developer tank, a toner concentration detecting sensor for detecting a toner concentration inside said developer tank, a developer amount estimating sensor for estimating an amount of said developer-tank-contained developer existing inside said developer tank, a discharging mechanism provided in said developer tank to discharge an excessive amount of said developer-tank-contained developer outside said developer tank when said amount of said developer-tank-contained developer inside said developer tank exceeds a predetermined amount, and a controller for controlling a replenishment operation for replenishing said toner and said carrier for replenishment from said developer replenishing tank to said developer tank when said toner concentration detected using said toner concentration detecting sensor is lower than a predetermined reference toner concentration, comprising the steps of:

calculating said toner concentration using said toner concentration detecting sensor;

estimating said amount of said developer-tank-contained developer using said developer amount estimating sensor;

determining the specified amounts of said and said carrier to be replenished on the basis of said calculated toner concentration and said estimated amount of said developer; and replenishing a mixture of said specified amounts of said toner and said carrier determined at said replenishment amount determining step from said developer replenishing tank to said developer tank.

14. The developing method according to claim 13, wherein said toner concentration detecting sensor is installed in an area in which density of said developer-tank-contained developer inside said developer tank is high and said developer amount estimating sensor is installed in an area in which density of said developer-tank-contained developer inside said developer tank is low.

15. The developing method according to claim 14, wherein said installation area of said toner concentration detecting sensor is an area around an extreme downstream position of a first conveying passage located away from said latent image holder, and said installation area of said developer amount estimating sensor is an area on an upstream side of said extreme downstream position of said first conveying passage.

16. The developing method according to claim 14, wherein said installation area of said toner concentration detecting sensor is an area located below said installation area of said developer amount estimating sensor in a side view of a first conveying passage.

17. The developing method according to claim 13, wherein said developing apparatus has a first conveying passage for conveying said developer from a first end of said developer tank to a second end of said developer tank, and a second conveying passage for conveying said developer from said second end of said developer tank to said first end of said developer tank, wherein said toner concentration sensor is located adjacent said second end of said developer tank.

18. A developing apparatus comprising:

a developer tank for accommodating a developer-tank-contained developer containing toner and carrier;

a developer holder for supplying said developer-tank-contained developer inside said developer tank to an electrostatic latent image holder;

stirring members, disposed inside said developer tank and adjacent to said developer holder, for stirring said developer-tank-contained developer while circulating and conveying said developer inside said developer tank;

a developer replenishing tank for replenishing said toner and said carrier to said developer tank;

a first toner concentration detecting sensor installed in an area in which the density of said developer-tank-contained developer inside said developer tank is high;

replenishing device for replenishing a mixture of predetermined amounts of said toner and said carrier depending on an output of said first toner concentration detecting sensor from said developer replenishing tank to said developer tank;

a discharging mechanism provided in said developer tank to discharge an excessive amount of said developer-tank-contained developer outside said developer tank when said amount of said developer-tank-contained developer inside said developer tank exceeds a predetermined amount;

a second toner concentration detecting sensor installed in an area in which density of said developer-tank-contained developer inside said developer tank is low; and adjusting device for adjusting said predetermined amounts supplied from said developer replenishing tank depending on an output of said second toner concentration detecting sensor.

19. The developing apparatus according to claim 18, wherein said adjusting device estimates said amount of said developer-tank-contained developer on the basis of said output of said second toner concentration detecting sensor and decreases the replenishment amounts of said toner and said carrier to amounts smaller than said predetermined amounts when said amount of said developer-tank-contained developer inside said developer tank is less than said predetermined amount.

20. The developing apparatus according to claim 18, further comprising a developing roller at an opening section of said developer tank.

* * * * *